US006988729B2

(12) United States Patent
Tamura et al.

(10) Patent No.: US 6,988,729 B2
(45) Date of Patent: Jan. 24, 2006

(54) SHEET CONVEYING DEVICE AND IMAGE FORMING APPARATUS INCLUDING THE SAME

(75) Inventors: Masahiro Tamura, Kanagawa (JP); Kenji Yamada, Tokyo (JP); Nobuyoshi Suzuki, Tokyo (JP); Hiroki Okada, Kanagawa (JP); Junichi Iida, Kanagawa (JP); Akihito Andoh, Kanagawa (JP); Hiromoto Saitoh, Kanagawa (JP); Shuuya Nagasako, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 287 days.

(21) Appl. No.: 10/443,028

(22) Filed: May 22, 2003

(65) Prior Publication Data

US 2003/0234487 A1 Dec. 25, 2003

(30) Foreign Application Priority Data

May 22, 2002 (JP) ..... 2002-147938

(51) Int. Cl.
*B65H 39/10* (2006.01)

(52) U.S. Cl. ..... 271/303

(58) Field of Classification Search ..... 271/303, 271/305, 184, 185

See application file for complete search history.

(56) References Cited

U.S. PATENT DOCUMENTS

| | | | | |
|---|---|---|---|---|
| 4,486,015 | A * | 12/1984 | Takahashi | 271/305 |
| 4,570,922 | A * | 2/1986 | Akers | 271/178 |
| 4,718,660 | A * | 1/1988 | Daboub | 271/305 |
| 4,785,942 | A * | 11/1988 | Van Leijenhorst et al. | 209/657 |
| 5,093,690 | A * | 3/1992 | Ohno et al. | 399/402 |
| 5,226,547 | A * | 7/1993 | Malatesta | 209/657 |
| 5,762,328 | A | 6/1998 | Yamada et al. | |
| 6,145,825 | A | 11/2000 | Kunihiro et al. | |
| 6,176,485 | B1 * | 1/2001 | Wingate | 271/303 |
| 6,196,464 | B1 * | 3/2001 | Patterson et al. | 235/477 |
| 6,199,853 | B1 | 3/2001 | Andoh et al. | |
| 6,231,045 | B1 | 5/2001 | Yamada et al. | |
| 6,264,191 | B1 | 7/2001 | Suzuki et al. | |
| 6,296,247 | B1 | 10/2001 | Tamura et al. | |
| 6,322,070 | B2 | 11/2001 | Yamada et al. | |
| 6,343,785 | B1 | 2/2002 | Yamada et al. | |
| 6,394,448 | B2 | 5/2002 | Suzuki et al. | |
| 6,416,052 | B2 | 7/2002 | Yamada et al. | |
| 6,494,449 | B2 | 12/2002 | Tamura et al. | |
| 6,494,453 | B1 | 12/2002 | Yamada et al. | |
| 6,527,269 | B2 | 3/2003 | Yamada et al. | |
| 6,533,271 | B1 * | 3/2003 | Zimmermann | 271/303 |
| 6,549,734 | B2 | 4/2003 | Yamada et al. | |
| 6,595,518 | B2 * | 7/2003 | Dobrindt | 271/303 |
| 6,644,655 | B2 * | 11/2003 | Wurschum | 271/225 |
| 2005/0082747 | A1 * | 4/2005 | Tamura et al. | 271/184 |

FOREIGN PATENT DOCUMENTS

| | | | |
|---|---|---|---|
| JP | 04148763 | A * | 5/1992 |
| JP | 04308147 | A * | 10/1992 |
| JP | 5-286627 | | 11/1993 |
| JP | 7-252002 | | 10/1995 |
| JP | 7-315668 | | 12/1995 |
| JP | 2000-53302 | | 2/2000 |

* cited by examiner

*Primary Examiner*—Donald P. Walsh
*Assistant Examiner*—Matthew J. Kohner
(74) *Attorney, Agent, or Firm*—Oblon, Spivak, McClelland, Maier & Neustadt, P.C.

(57) ABSTRACT

A sheet conveying device of the present invention includes a sheet conveying mechanism for conveying a sheet, path selectors each for steering the sheet being conveyed by the sheet conveying mechanism in a particular direction, and a drive mechanism for causing the path selectors to move independently of each other. The path selectors are rotatable about a single axis and positioned parallel to each other in such a manner as to sandwich a plane of sheet conveyance.

33 Claims, 11 Drawing Sheets

SHEET CONVEYING DEVICE AND IMAGE FORMING APPARATUS INCLUDING THE SAME

BACKGROUND OF THE INVENTION

1. Field of the Invention

The present invention relates to a sheet conveying device for conveying a sheet in an image forming apparatus or an image forming system including the same and more particularly to a sheet conveying device of the type using path selectors and a sheet finisher including the same.

2. Description of the Background Art

A sheet conveying devices of the type including a path that branches off in a plurality of directions is conventional. In this type of sheet conveying device, when the path branches off at two positions by way of example, two path selectors are serially arranged on the path for steering a sheet. However, the problem with this configuration is that the two path selectors positioned one after the other occupy substantial part of the path corresponding to the sum of their widths in the direction of conveyance. Stated another way, the path needs a width corresponding to the total width of the path selectors for steering the sheet. Consequently, a sheet finisher or similar apparatus, which includes the sheet conveying device, increases in width in the right-and-left direction, as seen from the operator's side, increasing the size of the casing of the sheet finisher in the direction parallel to the direction of sheet conveyance.

If the two path selectors are not serially arranged, but are arranged in parallel to each other, then the size of the sheet conveying device can be reduced by the width of one path selector. Parallel arrangement of two path selectors are taught in, e.g., Japanese Patent Laid-Open Publication Nos. 7-315668 and 2000-53302.

More specifically, in Laid-Open Publication No. 7-315668 mentioned above, two parallel path selectors are rotated simultaneously with each other, i.e., not independently of each other. This, however, gives rise to a problem that the path selectors occupy a wide area when rotated, and moreover a solenoid capable of outputting great power is required for driving the path selectors.

In Laid-Open Publication No. 2000-53302 also mentioned above, a first and a second path selector are located at a first and a second branching position, respectively, and interconnected by a first, a second and a third link member. A solenoid actuates the two path selectors via the link members. A third path selector is additionally located at the second branching position and driven about a fulcrum independent of the fulcrum of the second path selector. This configuration, however, has a problem that when the edge of upper one of the second and third path selectors, which are movable about the respective fulcrums, is brought into contact with the upper surface of the lower path selector, the distance between the edges of the two path selectors increases. It is therefore likely that a sheet cannot be accurately conveyed and jams the path. Although this problem may be solved if the edges of the upper and lower path selectors are configured as comb teeth, such comb-teeth edges are apt to catch, when a tab sheet is conveyed, the tab of the sheet. The arrangement taught in the above document will be described more specifically later with reference to the accompanying drawings.

Technologies relating to the present invention are also disclosed in, e.g., Japanese Patent Laid-Open Publication Nos. 5-286672, 7-252002 and 2002-154728.

SUMMARY OF THE INVENTION

It is an object of the present invention to provide a sheet conveying device capable of surely dealing even with a tab sheet, obviating a sheet jam at path selectors, and saving space.

A sheet conveying device of the present invention includes a sheet conveying mechanism for conveying a sheet, path selectors each for steering the sheet being conveyed by the sheet conveying mechanism in a particular direction, and a drive mechanism for causing the path selectors to move independently of each other. The path selectors are rotatable about a single axis and positioned parallel to each other in such a manner as to sandwich a plane of sheet conveyance.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
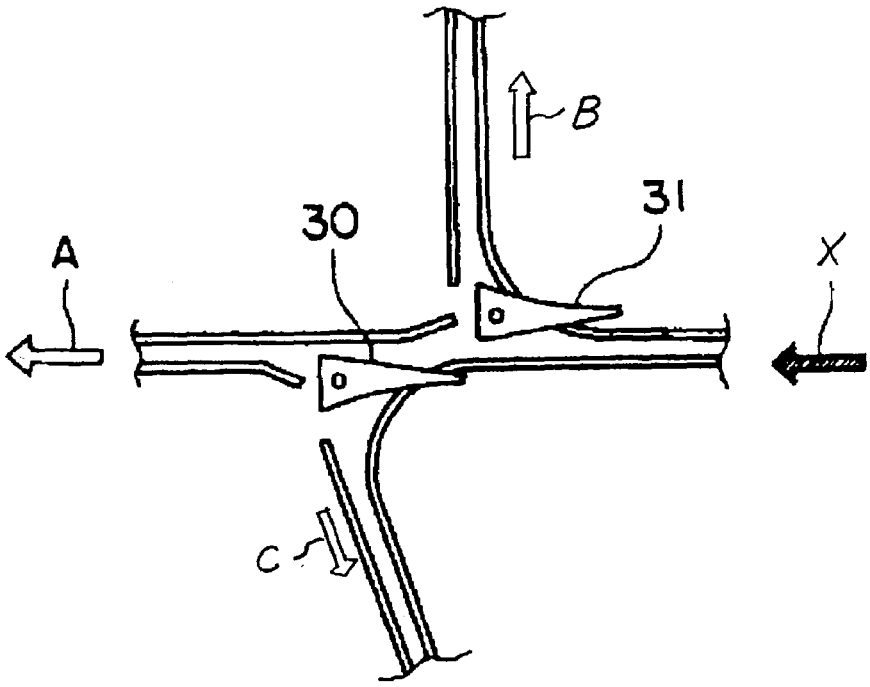
FIG. 1 PRIOR ART
FIG. 1 is a view showing path selectors included in a conventional sheet conveying device and positioned to convey a sheet straightforward.
Figure 2:
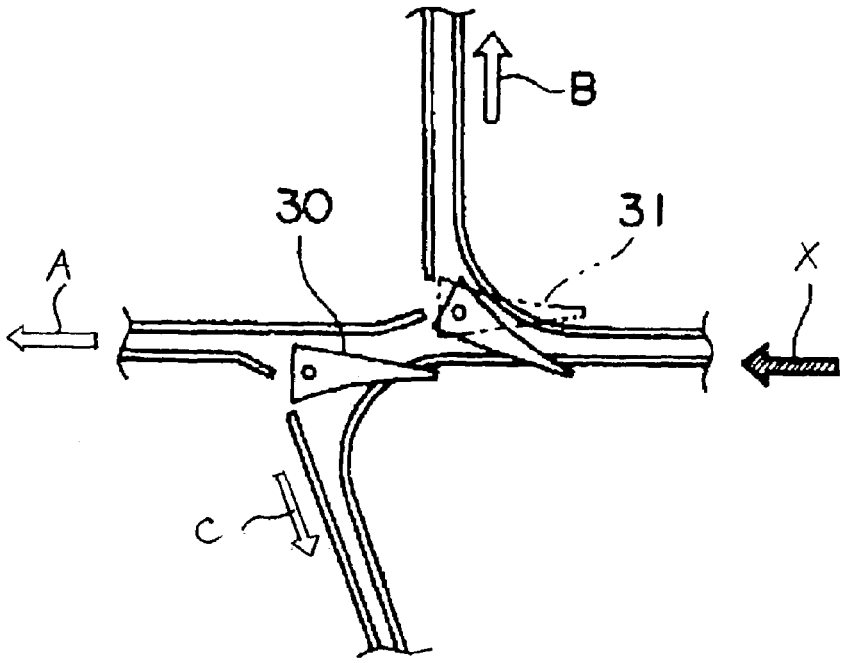
FIG. 2 PRIOR ART
FIG. 2 is a view similar to FIG. 1, showing the path selectors positioned to steer a sheet upward.
Figure 3:
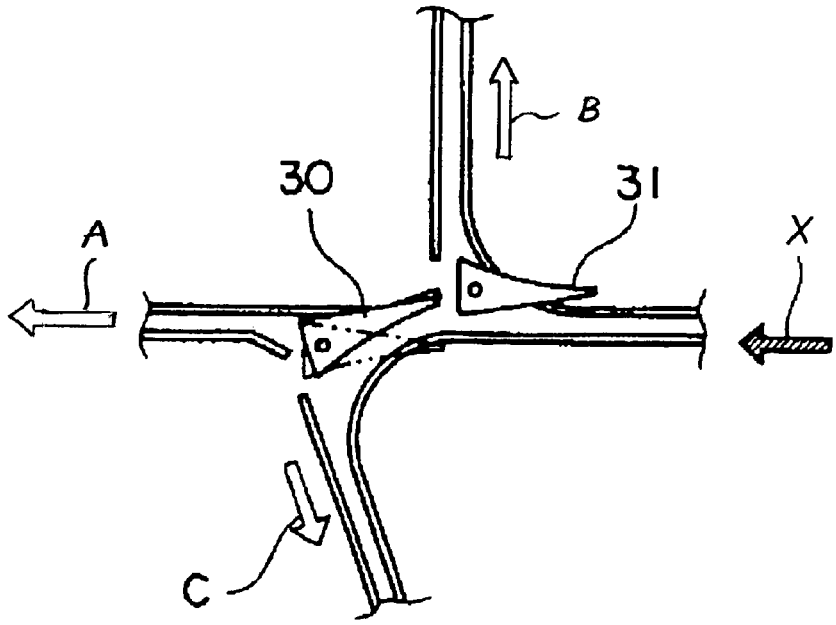
FIG. 3 PRIOR ART
FIG. 3 is a view also similar to FIG. 1, showing the path selectors positioned to steer a sheet downward.

To better understand the present invention, brief reference will be made to a conventional sheet conveying device, shown in FIGS. 1 through 3. As shown, the sheet conveying device includes a path branching off such that a sheet, coming in in a direction X, is steered to any one of three different directions A, B and C. More specifically, two path selectors 31 and 30 are serially arranged on the above path and respectively assigned to the directions A and B and directions A and C. As shown in FIG. 2, the upstream path selector 31 in the direction X selectively steers the sheet to the direction A (straightforward) or the direction B (upward) while the downstream path selector 30 selectively steers the sheet steered to the direction A to the direction A or the direction C (downward).

However, the two path selectors 31 and 30 positioned one after the other occupy substantial part of the path corresponding to the sum of their widths in the direction of conveyance. Stated another way, the path needs a width corresponding to the total width of the path selectors 31 and 30 for steering the sheet. Consequently, a sheet finisher or similar apparatus, which includes the sheet conveying device, increases in width in the right-and-left direction, as seen from the operator's side), increasing the size of the casing of the apparatus in the direction parallel to the direction of sheet conveyance.

In light of the above, Laid-Open Publication Nos. 7-315668 and 2000-53302 each propose to arrange two path selectors in parallel for thereby reducing the size of the apparatus by the width of one path selector, as stated earlier. However, the parallel arrangement of path selectors taught in the above documents gives rise to other problems discussed previously.

Figure 4:
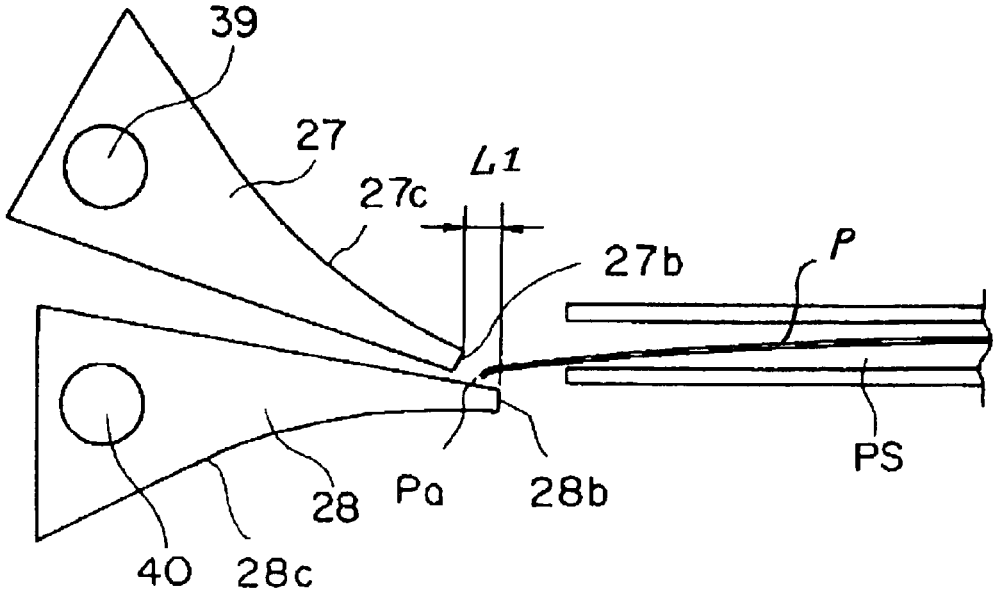
FIG. 4 PRIOR ART
FIG. 4 is a view showing another conventional sheet conveying device in which two path selectors are positioned parallel to each other and rotatable about respective fulcrums.

Specifically, FIG. 4 shows two parallel path selectors 27 and 28 taught in Laid-Open Publication No. 2000-53302. As shown, the path selectors 27 and 28 are respectively driven about fulcrums 39 and 40 independently of each other. Assume that the edge 27*b* of the upper path selector 27 is brought into contact with the upper surface of the lower path selector 28 in order to switch a path PS upward. Then, as the locus from the center of movement indicates, a distance L1 between the edge 27*b* of the path selector 27 and the edge 28*b* of the path selector 28 increases. As a result, the leading edge Pa of a sheet P, coming in via the path PS, contacts the upper surface of the path selector 28 and is guided toward the downstream side thereby and then abuts against the edge 27*b* of the path selector 27. Consequently, the sheet jams the path without being guided upward.

Figure 5:
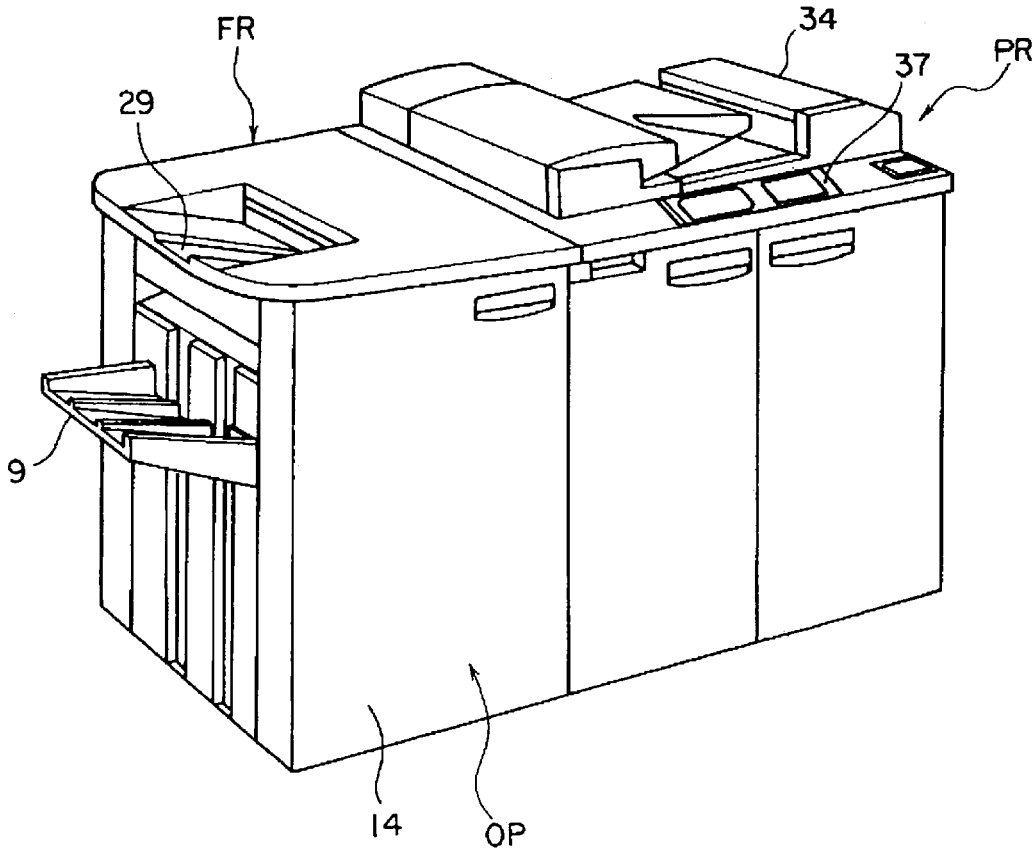
FIG. 5 is an external isometric view showing an image forming system made up of an image forming apparatus and a sheet conveying device embodying the present invention.
Figure 6:
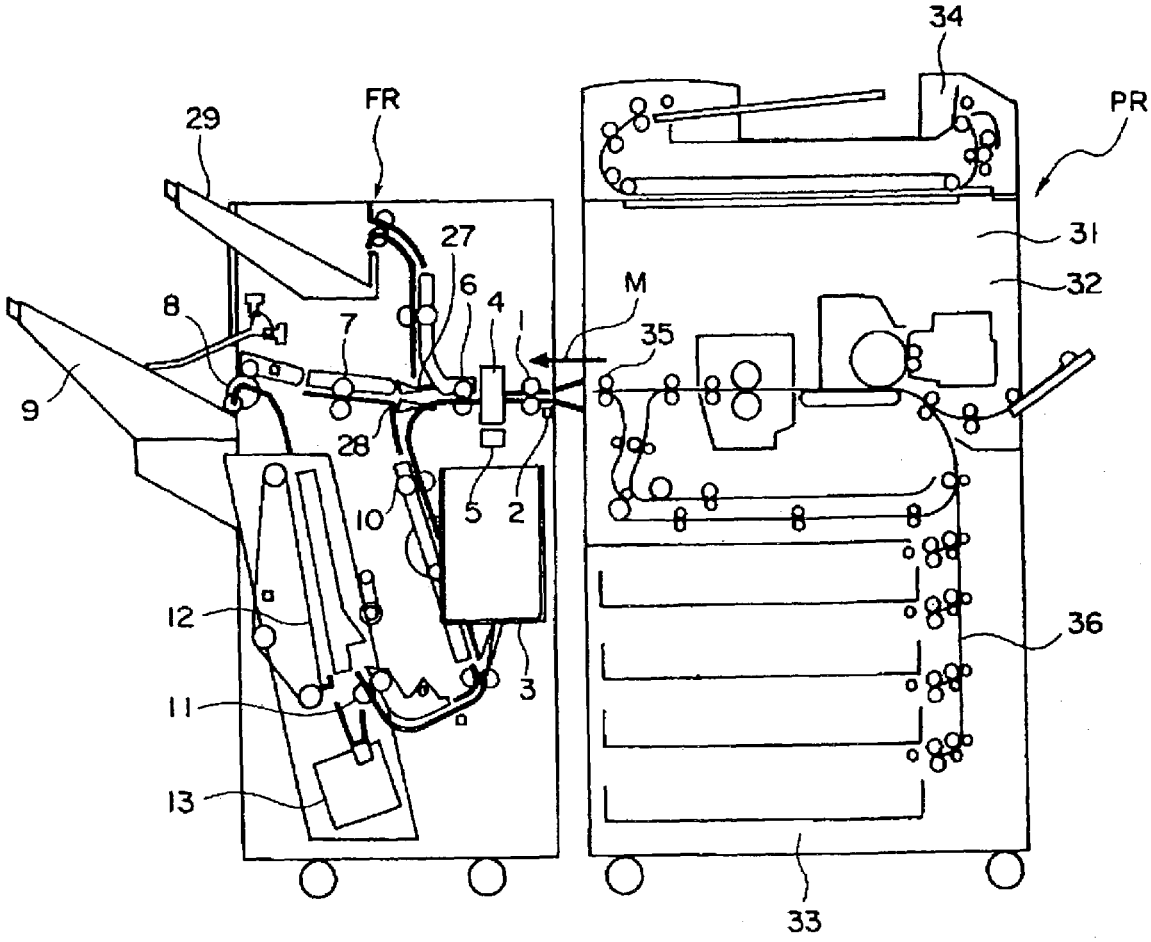
FIG. 6 is a view showing arrangements disposed in the image forming system.

Referring to FIG. 5, an image forming system embodying the present invention is shown in an external view and made up of an image forming apparatus PR and a sheet finisher FR. FIG. 6 shows various arrangements disposed in the image forming system. As shown, the image forming apparatus PR, having a copying function, is generally made up of an image reading section 31, an image writing section 32, a sheet feeding section 33, and a document feeding section 34.

The image reading section 31 reads a document with a scanner, not shown, in the main scanning direction while reading it in the subscanning direction by driving the scanner. The document feeding section 34 is implemented as an ADF (Automatic Document Feeder) and feeds the above document to a glass platen not shown. The image writing section 32 is implemented by conventional optics including a laser diode, a polygonal mirror and an F-θ lens, not shown, and optically writes an image on a photoconductive drum or image carrier in accordance with image data. The latent image is then developed by toner to thereby become a toner image. The toner image is transferred from the drum to a sheet.

Subsequently, the toner image is fixed on the sheet by a fixing unit. The sheet with the toner image thus fixed is handed over from the image forming apparatus PR to the sheet finisher FR via an outlet roller pair 35. In the illustrative embodiment, the sheet feeding section 33 includes a stack of four sheet trays, as illustrated. A vertical path 36 extends at the right-hand side or outlet side of the trays. A sheet paid out from any one of the trays is conveyed to the image writing section 32 via the vertical path 36.

The sheet with the toner image and driven out of the image forming apparatus PR enters the sheet finisher FR in a direction indicated by an arrow M. A punching unit 4 is positioned in the sheet finisher FR downstream of an inlet roller pair 1, but upstream of a roller pair 6, in the direction of sheet conveyance. A conveying unit 5 is positioned beneath the punching unit 4 and extends perpendicularly to the direction of sheet conveyance. After the punching unit 4 has punched the sheet entered the sheet finisher FR, the conveying unit 5 conveys the resulting scraps to a scrap hopper 3 adjoining the operating side OP, FIG. 5. The operator, standing at the operating side OP, inputs desired processing meant for the sheet finisher FR or the image forming apparatus PR on a control panel 37 or replaces toner or removes a jamming sheet, as the case may be. The scrap hopper 3 is mounted on the inside of a front cover 14, which the operator is expected to open for replacing toner or removing a jamming sheet.

The sheet punched by the punching unit 4 is conveyed via path selectors 27 and 28 positioned downstream of the roller pair 6, subject to sorting, stapling or similar processing, and then driven out to a shift tray 9. Alternatively, the sheet may be simply driven out to a proof tray 29 via an upper path.

More specifically, in a sort mode, the path selector 27 unblocks a path on which a roller pair 7 is positioned while the path selector 28 blocks a path on which a roller pair 10 is positioned. In this condition, the sheet is driven out to the shift tray 9 via an outlet roller pair 8. The shift tray 9 is shifted copy by copy in the direction perpendicular to the direction of sheet conveyance for thereby sorting the consecutive copies (sets of sheets).

In a staple mode, the path selector 7 unblocks the path including the roller pair 7 while the path selector 28 unblocks the path including the roller pair 10, so that the sheet is stacked on a staple tray 12 via a staple discharge roller 11. Every time a sheet is stacked on the staple tray 12, a knock roller knocks it downward against a rear fence, and then jogger fences position the sheet in the direction perpendicular to the direction of sheet discharge. When a single copy or set of sheets is fully stacked on the staple tray 12, a stapler 13 staples, e.g., the rear edge of the stack. Subsequently, a belt conveys the stapled stack upward toward the outlet roller pair 8, so that the stapled stack is driven out to the shift tray 9.

As stated above, the punching unit 4 and scrap hopper 3 are positioned most upstream of the various finishing steps and can basically deal with all sheets. It is therefore possible to directly deliver the punched sheet to either one of the proof tray 29 and shift tray 9 or to staple a punched sheet stack and deliver it to the shift tray 9.

While the illustrative embodiment forms an image on the basis of a document optically read by the image reading unit 31, an image may, of course, be formed in accordance with image data received from a data processing unit either directly or via a network. The punching timing of the punching unit 4 and the switching timing of the path selectors 27 and 28 are determined in accordance with the output of an inlet sensor 2 responsive to the leading edge of a sheet.

Figure 7:
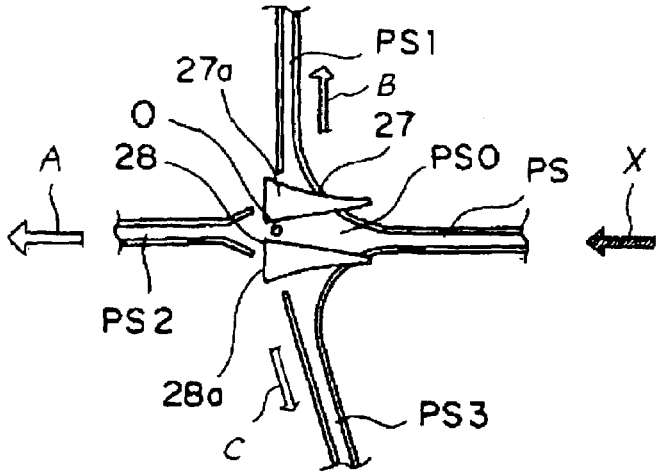
FIG. 7 is a view showing path selectors included in the illustrative embodiment and positioned to convey a sheet straightforward.
Figure 8:
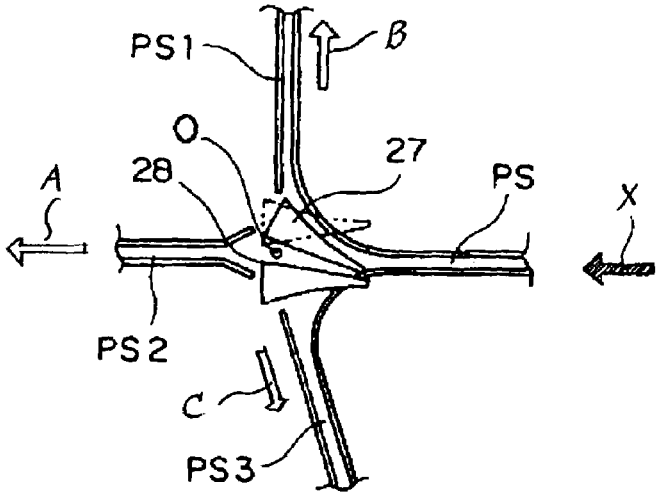
FIG. 8 is a view similar to FIG. 7, showing the path selectors positioned to steer a sheet upward.
Figure 9:
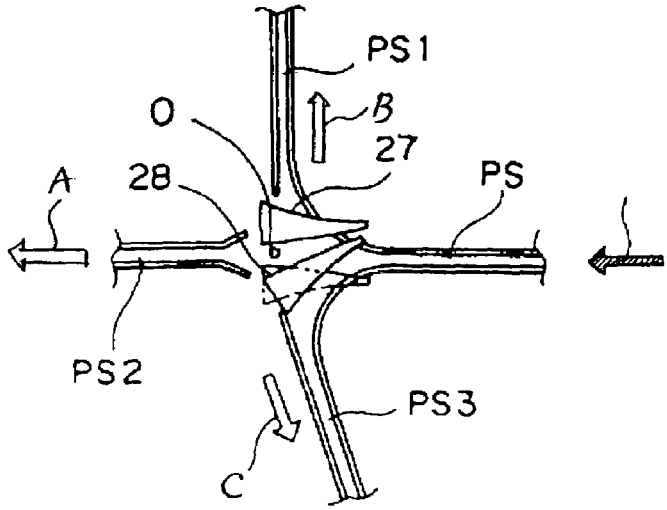
FIG. 9 is a view similar to FIG. 7, showing the path selectors positioned to steer a sheet downward.

As shown in FIGS. 7 through 9, the sheet finisher FR includes an upper path PS1, a middle path PS2 and a lower path PS3 into which an inlet path PS merges. A sheet is conveyed along the inlet path PS in a direction X. The proof tray 29 is positioned at the downstream end of the path PS1 while the shift tray 9 is positioned at the downstream end of the paths PS2 and PS3. It is noteworthy that the path PS does not branch into the three paths PS1 through PS3 at two consecutive positions as in FIGS. 1 through 3, but branches at a single position.

The proof tray 29 receives sheets not finished at all. The shift tray 9 sorts consecutive copies one by one by shifting them in the direction perpendicular to the direction of sheet conveyance and moves upward or downward in accordance with the number of copies stacked thereon. For this purpose, a motor for shifting the shift tray 9, a control mechanism and a motor for moving the shift tray 9 in the up-and-down direction are provided.

The roller pairs 7 and 8 positioned on the middle path PS2 deliver a sheet conveyed via the middle path PS2 to the shift tray 9. A discharge roller pair 10, the staple discharge roller pair 11 and the stapling unit 12 are arranged on the lower path PS3.

The first path selector 27 steers a sheet toward the proof tray 29 in a proof mode or steers it toward the shift tray 9 via the roller pair 7 in a shift mode. The second path selector 28 steers a sheet toward the shift tray 9 via the roller pair 7 or steers it toward the staple tray 12 via the roller pair 11.

Reference will be made to FIGS. 7 through 9 for describing the operations of the path selectors 27 and 28. As shown in FIG. 7, when a sheet should be conveyed to the roller pair 7 straightforward, the path selectors 27 and 28 both are held in their initial positions, so that a sheet, coming in in the direction X, is driven out in a direction A. As shown in FIG. 8, to convey the sheet upward, the path selector 27 is rotated clockwise about a fulcrum or shaft O, so that the sheet conveyed in the direction X is delivered to the proof tray 29 in a direction B. Further, as shown in FIG. 9, to convey the sheet downward, the path selector 28 is rotated counterclockwise about the fulcrum O, so that the sheet is steered toward the staple tray 12 in a direction C.

Figure 10:
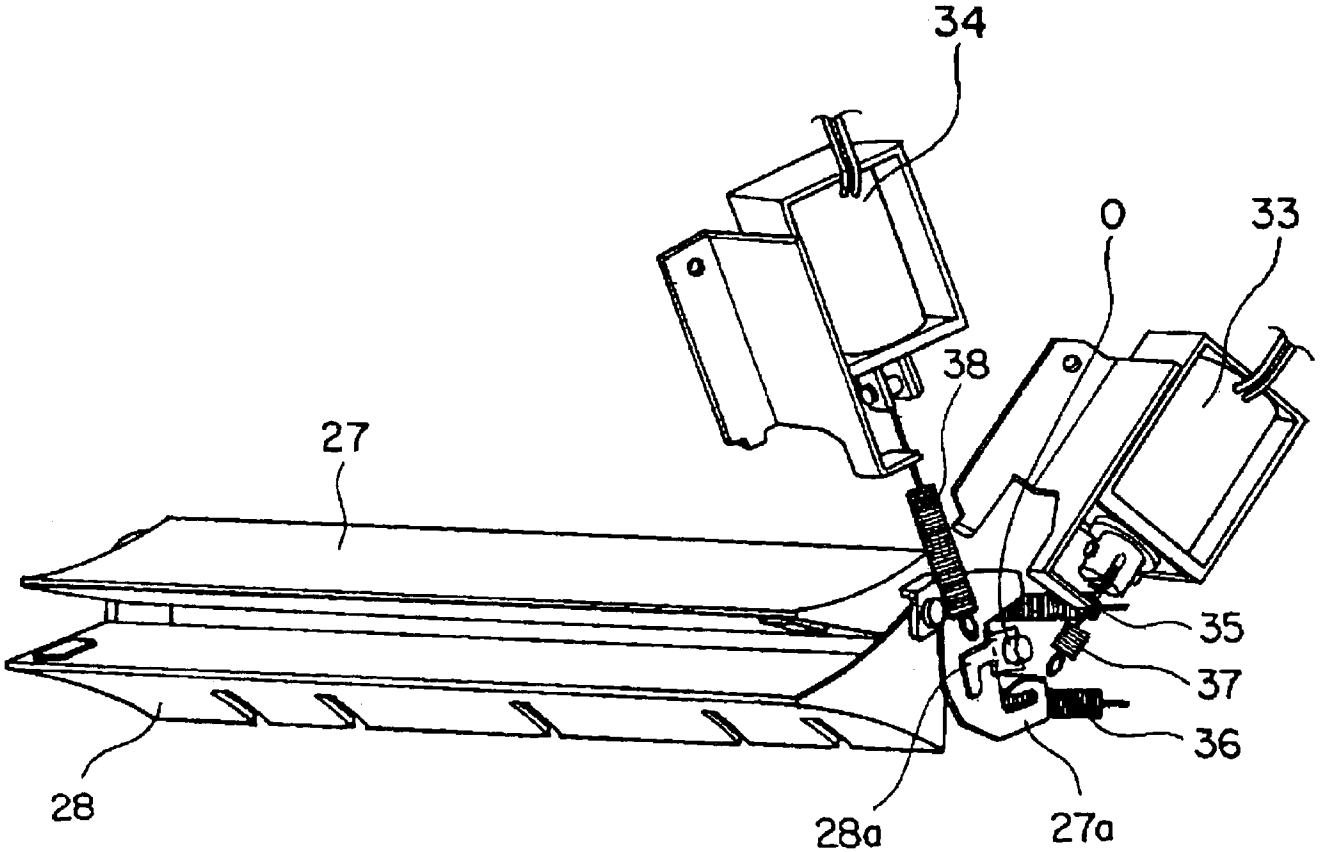
FIGS. 10 and 11 are respectively an isometric view and a side elevation showing the path selectors of the illustrative embodiment together with a mechanism for driving them.
Figure 11:
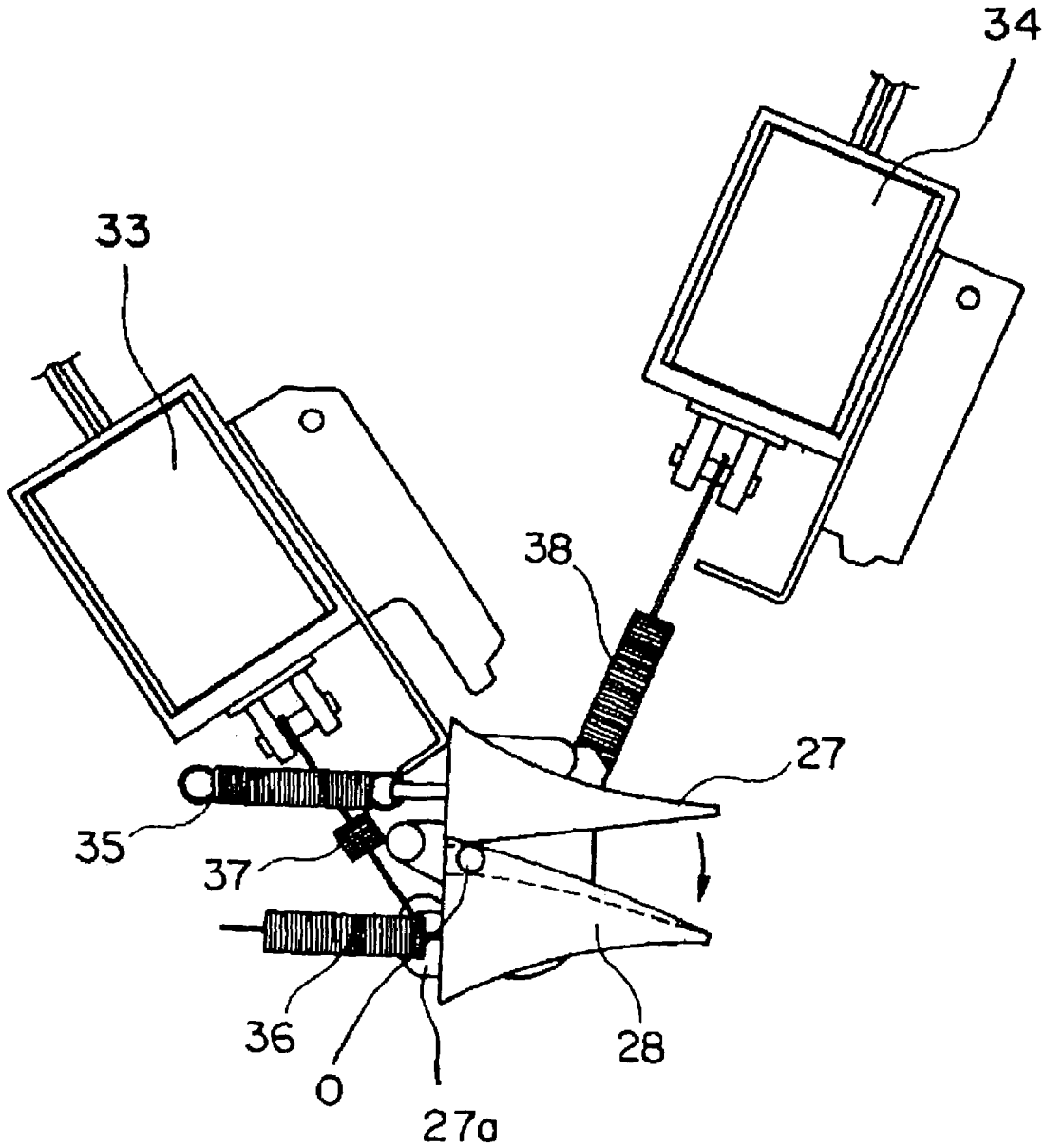

The path selectors 27 and 28 will be described more specifically hereinafter together with a mechanism for driving them. FIGS. 10 and 11 show the path selectors 27 and 28 and drive mechanism in an isometric view and a side elevation, respectively. As shown, the path selectors 27 and 28 are generally wedge-shaped in a section and rotatable about a single shaft O independently of each other. The shaft adjoins the bottoms of the wedge-shapes of the path selectors 27 and 28 between the path selectors 27 and 28. The path selectors 27 and 28 are respectively connected to a first and a second spring 35 and 36, which establish the initial or default positions, and respectively connected to a third and a fourth spring 37 and 38 that establish the switched positions. A first and a second solenoid 33 and 34 are respectively connected to the other ends of the third and fourth springs 37 and 38 so as to move the path selectors 27 and 28 via the springs 37 and 38, respectively.

The first and second path selectors 27 and 28 are held at their initial positions shown in FIG. 7 or 11 by the first and second springs 35 and 36, respectively. More specifically, the springs 35 and 36 bias the path selectors 27 and 28 along the axis in the direction of sheet conveyance such that no moments act on the path selectors 27 and 28. In this condition, the axes of the path selectors 27 and 28 are parallel to each other. When a sheet should be steered to the upper path PS1 in the direction B, the first solenoid 33 is turned on to pull a hook 27*a* included in the path selector 27 via the third spring 37, thereby rotating the path selector 27 to the position shown in FIG. 8. This condition is shown in FIG. 12 in an enlarged view.

Figure 12:
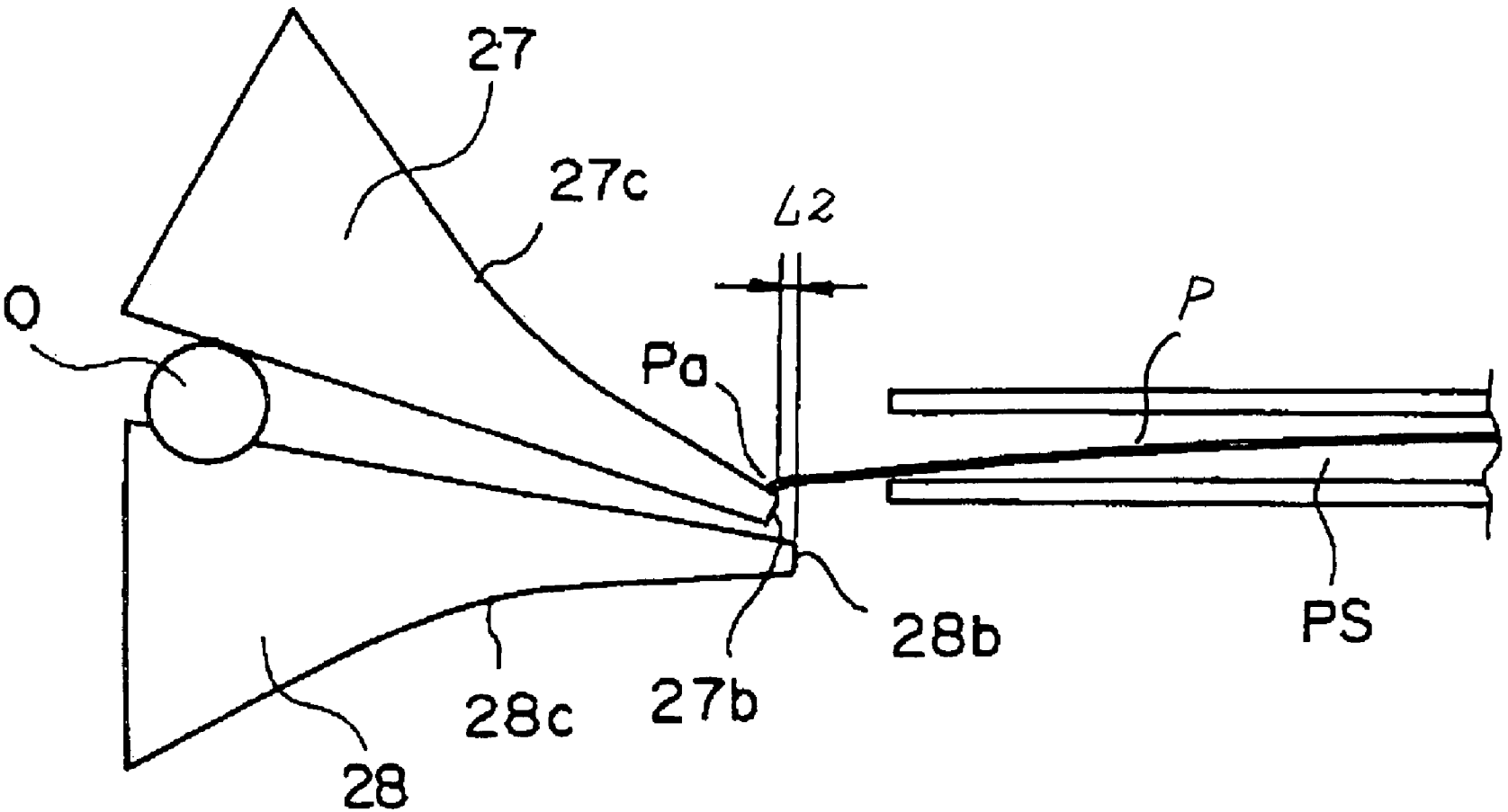
FIG. 12 is a fragmentary enlarged view showing a specific condition wherein one of the path selectors is switched.

As shown in FIG. 12, the path selector 27 rotates about the shaft O, so that the distance L2 between the edge 27*b* of the path selector 27 and the edge 28*b* of the path selector 28 is far smaller than the distance L1, FIG. 4. Therefore, the leading edge Pa of a sheet P, coming in via the path PS, surely contacts an inclined surface 27*c* included in the path selector 27 even when bent downward. The sheet P is therefore steered upward along the inclined surface 27*c* toward the upper path PS1.

By contrast, as shown in FIG. 4, when the path selectors 27 and 28 parallel to each other rotate about the respective axes 39 and 40 and when the path selector 27, for example, is switched, the distance L1 between the edges 27*b* and 28*b* of the path selectors 27 and 28 is great. As a result, if the leading edge Pa of the sheet P is bent downward, then it does not to contact the surface 27*c* of the path selector 27, but abuts against the leading edge 27*b* of the path selector 27, jamming the path.

In the illustrative embodiment, the two path selectors 27 and 28 rotate about a single fulcrum or shaft O. Therefore, when the lower path PS3 is selected in the condition of FIG. 7 so as to convey the sheet P in the direction C, the second solenoid 34 is turned on to pull a hook 28*a* included in the second path selector 28 via the fourth spring 38 to thereby rotate the path selector 28 to the position shown in FIG. 9. In this condition, the relation between the paths selectors 27 and 28 shown in FIG. 12 is inverted, i.e., the distance between the edge 27*b* of the path selector 27 and the edge 28*b* of the path selector 28 becomes L2. It follows that the sheet P can surely contact an inclined surface 28*c* included in the path selector 28 to be steered downward thereby along the inclined surface 28*c* toward the lower path PS3.

As stated above, the two path selectors 27 and 28 are rotatable about a single fulcrum or shaft, which is positioned between the path selectors 27 and 28. This successfully reduces the distance between the edges 27*a* and 28*b* when either one of the path selectors 27 and 28 is rotated from the initial position.

Figure 13:
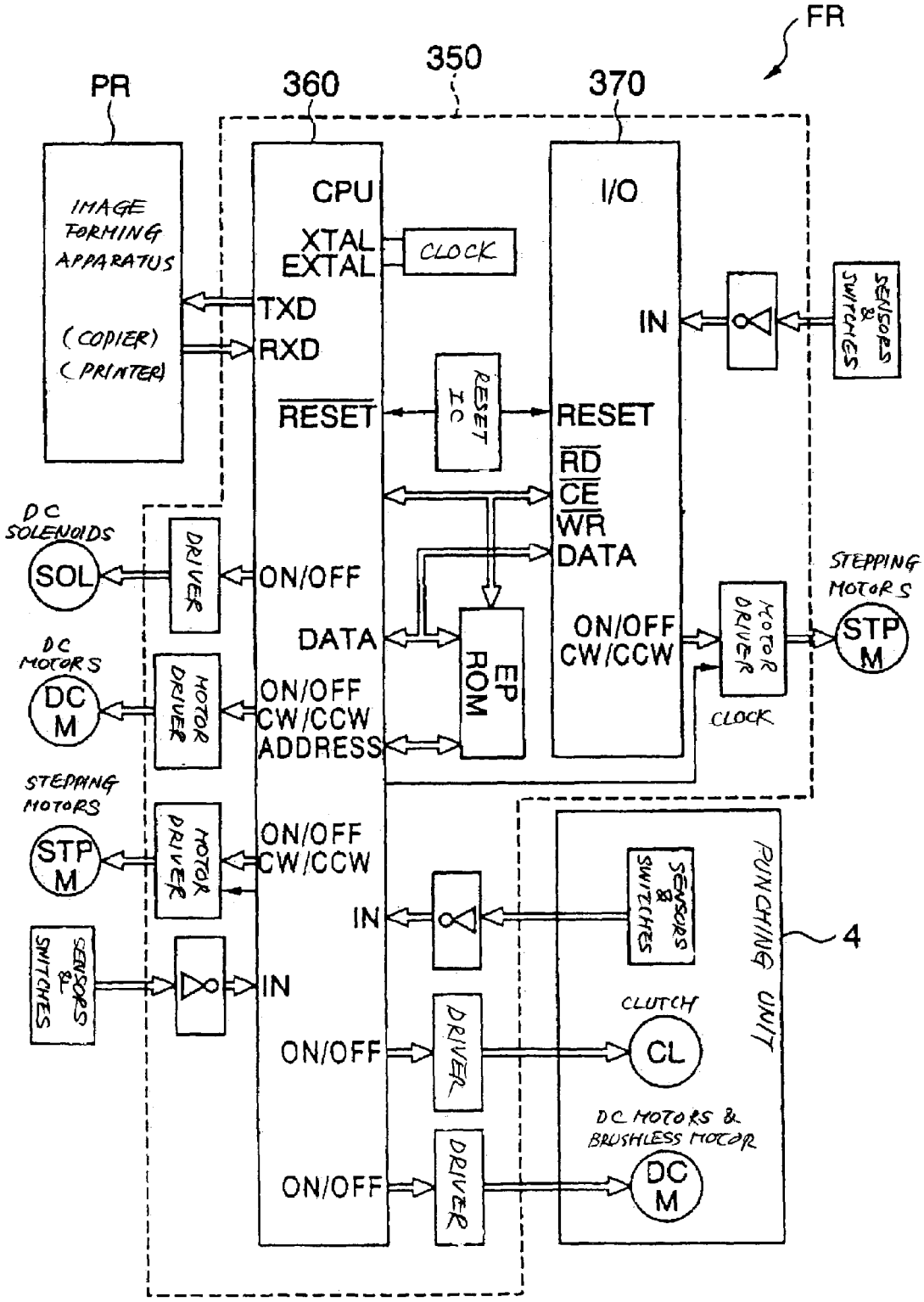
FIG. 13 is a block diagram schematically showing a control system included in the illustrative embodiment.

FIG. 13 shows a control system 350 included in the illustrative embodiment. As shown, the control system 350 is implemented as a microcomputer including a CPU (Central Processing Unit) 360 and an I/O (Input/Output) interface 370. The CPU 360 receives via the I/O interface 370 the outputs of various switches arranged on the control panel of the image forming apparatus PR and the outputs of various sensors including the inlet sensor 2, a sensor responsive to the discharge of a sheet to the shift tray 9, and a sensor responsive to the top of sheets stacked on the shift tray 9.

The CPU 360 controls, in accordance with the outputs mentioned above, the up-down movement of a punch included in the punching unit 4, the operation of the scrap conveying unit 5, jogging effected on the staple tray 12 in the direction perpendicular to the direction of sheet conveyance, stapling effected by the stapling unit 13 the staple tray 12, discharge of a stapled sheet stack from the staple tray 12, up-down movement and shift of the shift tray 9, operation of the knock roller, and so forth. More specifically, the CPU 360 controls the knock roller and jogging by counting pulses input to a motor assigned to the staple discharge roller 11.

It is to be noted that the CPU 360 controls the sheet finisher FR in accordance with a program stored in a ROM (Read Only Memory), not shown, while using a RAM (Random Access Memory), not shown, as a work area.

Figure 14:
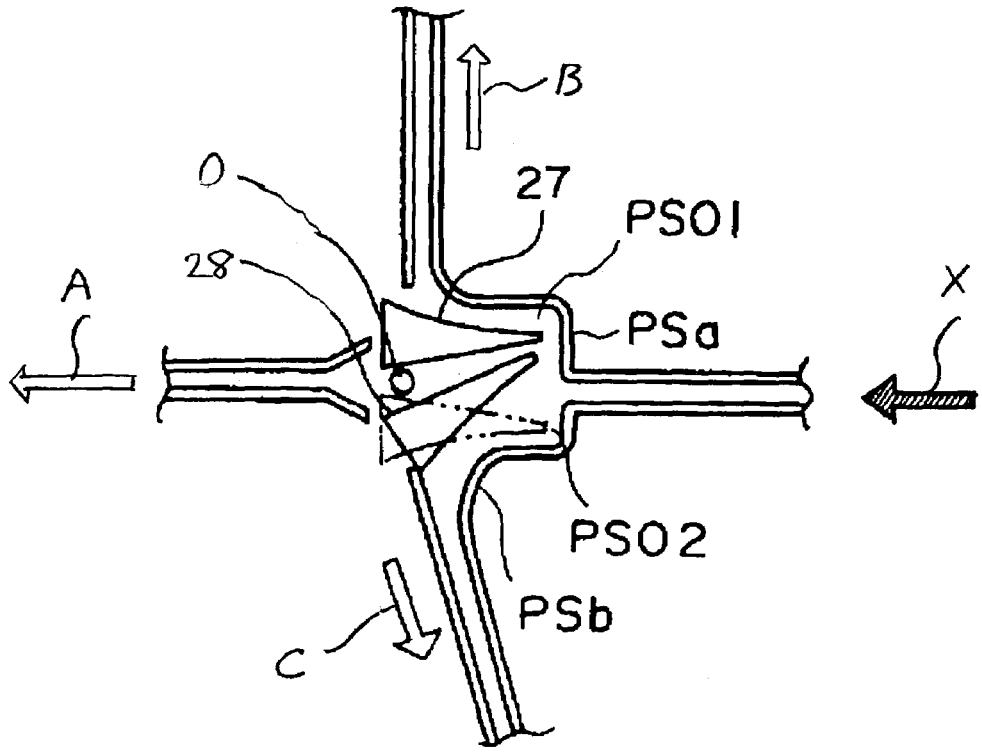
FIG. 14 is a view showing guide plates and the path selectors arranged at a branching position.
Figure 15:
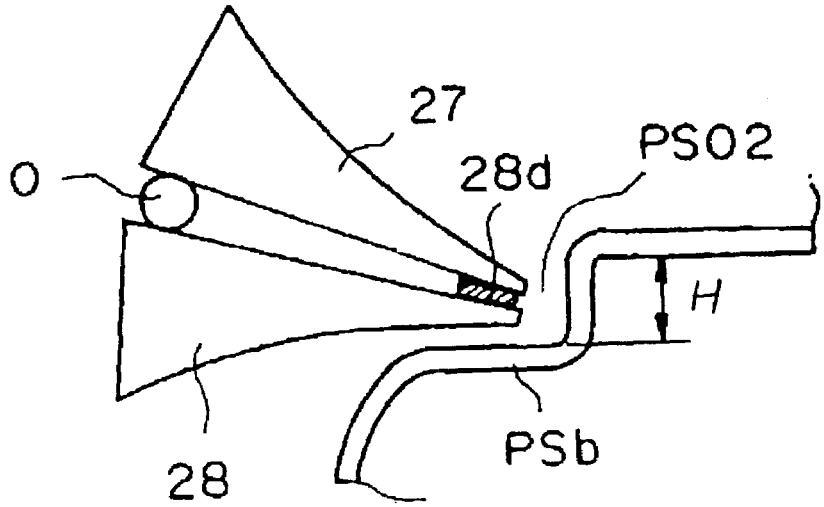
FIG. 15 is a view showing one of shock absorbing members affixed to the path selectors.

In FIGS. 7 through 9, the edges of the path selectors 27 and 28 are shown as being protruding to the outside of guide plates, the path selectors 27 and 28 are, in practice, angularly movably accommodated in a branching portion PSO, as shown in FIG. 14. The branching portion PSO is made up of spaces PSO1 and PSO2 contiguous with each other. As shown in FIG. 15, to prevent the sheet P from jamming the spaces PSO1 and PO2, the height H of each space PSO1 or PSO2 in the branching direction is made as small as possible for thereby preventing the leading edge Pa of the sheet P from contacting a guide plate PSa or PSb. It is therefore necessary to minimize the distance between the edges 27*b* and 28*b* of the path selectors 27 and 28 when the path selectors 27 and 28 are rotated. However, should the edges 27*b* and 28*b* contact each other, they would produce noise or would be damaged due to the resulting shock.

Figure 16:
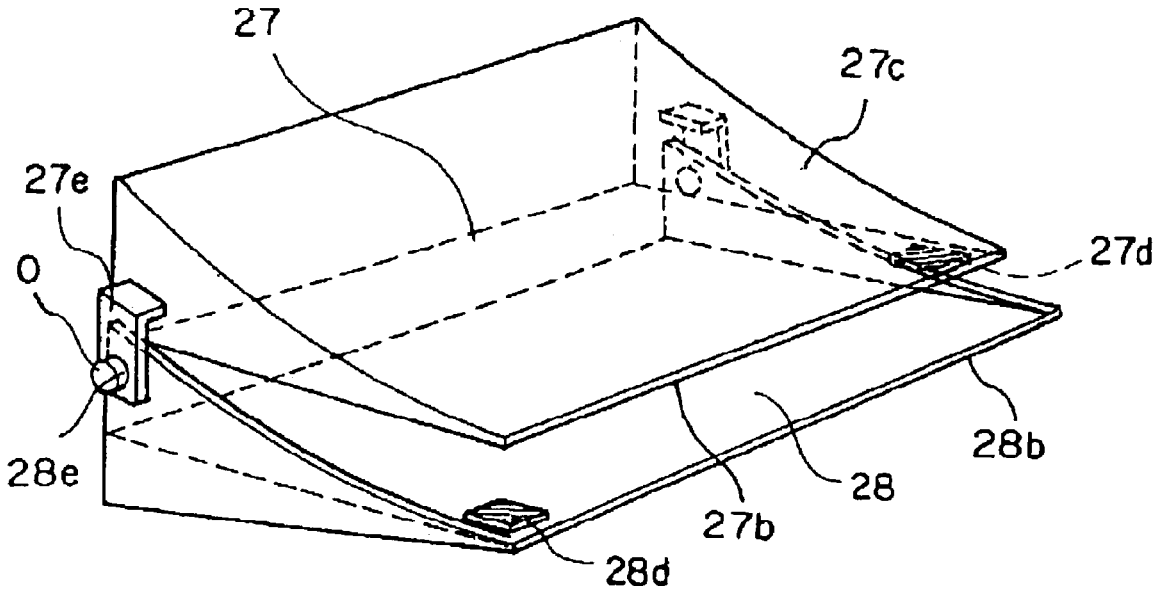
FIG. 16 is a perspective view showing the positions of the shock absorbing members on the path selectors.

In light of the above, as shown in FIG. 16, shock absorbing members 27*d* and 28*d* are respectively positioned on one end of the edge 27*b* of the path selector 27 and one end of the path selector 28 opposite to the above end. The shock absorbing members 27*d* and 28*d* are positioned outside of the maximum sheet size in the direction perpendicular to the direction of sheet conveyance and therefore do not obstruct the sheet P even when the sheet P is conveyed between the surfaces of the path selectors 27 and 28 facing each other, as shown in FIG. 7. To minimize the height H mentioned earlier, the shock absorbing members 27*d* and 28*d* are provided with minimum necessary thickness for absorbing shocks.

Figure 17:
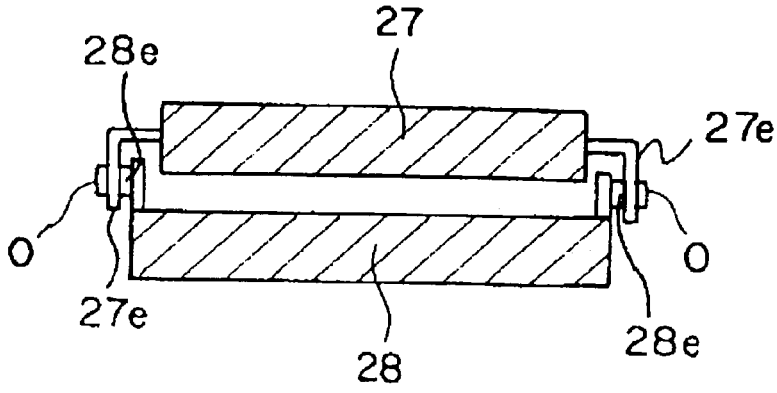
FIG. 17 is a view showing stubs that constitute the axis of rotation of the path selectors.

As shown in FIG. 17, the shaft O is implemented as two stubs O extending axially outward from support members 28*e*, which protrude from the second path selector 28. Support members 27*e* protrude from the first path selector 27, and each is formed with a hole receiving one of the stubs O. By suitably configuring the support members 28*e* and 27*e* as well as their engaging positions, it is possible to locate the stubs or shaft O at any desired position. While the stubs O should preferably be located symmetrically on an axis perpendicular to the direction of sheet conveyance, the above advantage is achievable only if the stubs O are positioned at the intermediate position of the conveyance path. Although the stubs O should preferably be positioned as far from the edges 27*a* and 27*b* of the path selectors 27 and 28 as possible, it suffices to locate the stubs O within the range of length of the path selectors 27 and 28.

As stated above, a single fulcrum O about which the parallel path selectors 27 and 28 are rotatable is positioned between the path selectors 27 and 28. This prevents the sheet P from abutting against the edge 27*b* or 28*b* for thereby further promoting stable conveyance.

Further, in the illustrative embodiment, the edges 27*b* and 28*b* of the path selectors 27 and 28 are not provided with a comb-teeth configuration, but are simply formed straight, allowing even a tab sheet to be surely conveyed without any jam.

While the illustrative embodiment has been shown and described as using the path selectors 27 and 28 to switch a path inside the sheet finisher FR, the present invention is similarly applicable to sheet processing to be effected at, e.g., the stage of the image forming apparatus PR preceding the image forming section or to sheet discharge (jam processing).

Because the path selectors 27 and 28 are parallel to each other, it is possible to save space by the length of at least one path selector in the direction of sheet conveyance.

In summary, it will be seen that the present invention provides a sheet conveying device capable of surely dealing even with a tab sheet by use of parallel path selectors, preventing a sheet from jamming a branching portion, and saving space.

Various modifications will become possible for those skilled in the art after receiving the teachings of the present disclosure without departing from the scope thereof.

What is claimed is:

1. A sheet conveying device comprising:

sheet conveying means for conveying a sheet;

a plurality of sheet steering means each for steering the sheet being conveyed by said sheet conveying means in a particular direction; and drive means for causing said plurality of sheet steering means to move independently of each other;

wherein said plurality of sheet steering means are rotatable about a single axis and positioned on opposite sides of a plane of sheet conveyance.

2. The device as claimed in claim 1, wherein the single axis is positioned between said plurality of sheet steering means.

3. The device as claimed in claim 2, wherein edges of said plurality of sheet steering means are positioned at substantially a same distance from the single axis as each other.

4. The device as claimed in claim 1, wherein one of said plurality of sheet steering means is rotatable about a shaft coaxial with a shaft about which the other sheet steering means is rotatable.

5. The device as claimed in claim 1, further comprising shock absorbing members positioned on surfaces of said plurality of sheet steering means, which face each other and are positioned on both sides of the single axis, such that said shock absorbing members do not lie in a range over which the sheet is conveyed.

6. The device as claimed in claim 5, wherein said shock absorbing members each are positioned at one end of one of said surfaces facing each other.

7. The device as claimed in claim 1, wherein said plurality of sheet steering means are positioned in a branching portion where a sheet conveying path branches off, and a guide plate positioned at a side of the plane of sheet conveyance, said guide plate is formed with a space for receiving a sheet steering means of said plurality of sheet steering means.

8. The device as claimed in claim 1, wherein said plurality of sheet steering means comprise path selectors each having a wedge-shaped section.

9. In a sheet processing device for executing preselected processing with a sheet conveyed thereto by a sheet conveying device or to be conveyed by said sheet conveying device, said sheet conveying device comprising:

sheet conveying means for conveying the sheet;

a plurality of sheet steering means each for steering the sheet being conveyed by said sheet conveying means in a particular direction; and drive means for causing said plurality of sheet steering means to move independently of each other;

wherein said plurality of sheet steering means are rotatable about a single axis and positioned on opposite sides of a plane of sheet conveyance.

10. The device as claimed in claim 9, wherein the single axis is positioned between said plurality of sheet steering means.

11. The device as claimed in claim 10, wherein edges of said plurality of sheet steering means are positioned at substantially a same distance from the single axis as each other.

12. The device as claimed in claim 9, wherein one of said plurality of sheet steering means is rotatable about a shaft coaxial with a shaft about which the other sheet steering means is rotatable.

13. The device as claimed in claim 9, further comprising shock absorbing members positioned on surfaces of said plurality of sheet steering means, which face each other and are positioned on both sides of the single axis, such that said shock absorbing members do not lie in a range over which the sheet is conveyed.

14. The device as claimed in claim 13, wherein said shock absorbing members each are positioned at one end of one of said surfaces facing each other.

15. The device as claimed in claim 9, wherein said plurality of sheet steering means are positioned in a branching portion where a sheet conveying path branches off, and a guide plate positioned at a side of the plane of sheet conveyance, said guide plate is formed with a space for receiving a sheet steering means of said plurality of sheet steering means.

16. The device as claimed in claim 9, wherein said plurality of sheet steering means comprise path selectors each having a wedge-shaped section.

17. An image forming apparatus comprising: a sheet conveying device configured to convey a sheet; and image forming means for forming a toner image on the sheet conveyed thereto by said sheet conveying device or to be conveyed by said sheet conveying device;

said sheet conveying device comprising: sheet conveying means for conveying the sheet;

a plurality of sheet steering means each for steering the sheet being conveyed by said sheet conveying means in a particular direction; and drive means for causing said plurality of sheet steering means to move independently of each other;

wherein said plurality of sheet steering means are rotatable about a single axis and positioned on opposite sides of a plane of sheet conveyance.

18. The apparatus as claimed in claim 17, wherein the single axis is positioned between said plurality of sheet steering means.

19. The apparatus as claimed in claim 18, wherein edges of said plurality of sheet steering means are positioned at substantially a same distance from the single axis as each other.

20. The apparatus as claimed in claim 17, wherein one of said plurality of sheet steering means is rotatable about a shaft coaxial with a shaft about which the other sheet steering means is rotatable.

21. The apparatus as claimed in claim 17, further comprising shock absorbing members positioned on surfaces of said plurality of sheet steering means, which face each other and are positioned on both sides of the single axis, such that said shock absorbing members do not lie in a range over which the sheet is conveyed.

22. The apparatus as claimed in claim 21, wherein said shock absorbing members each are positioned at one end of one of said surfaces facing each other.

23. The apparatus as claimed in claim 17, wherein said plurality of sheet steering means are positioned in a branching portion where a sheet conveying path branches off, and a guide plate positioned at a side of the plane of sheet conveyance, said guide plate is formed with a space for receiving a sheet steering means of said plurality of sheet steering means.

24. The device as claimed in claim 17, wherein said plurality of sheet steering means comprise path selectors each having a wedge-shaped section.

25. In an image forming system comprising an image forming apparatus and a sheet finisher constructed integrally with or separately from each other, said image forming apparatus comprising:

a sheet conveying device configured to convey a sheet; and image forming means for forming a toner image on the sheet conveyed thereto by said sheet conveying device or to be conveyed by said sheet conveying device;

said sheet finisher comprising:

sheet conveying means for conveying the sheet;

a plurality of sheet steering means each for steering the sheet being conveyed by said sheet conveying means in a particular direction; and drive means for causing said plurality of sheet steering means to move independently of each other;

wherein said plurality of sheet steering means are rotatable about a single axis and positioned on opposite sides of a plane of sheet conveyance.

26. The device as claimed in claim 25, wherein the single axis is positioned between said plurality of sheet steering means.

27. The device as claimed in claim 26, wherein edges of said plurality of sheet steering means are positioned at substantially a same distance from the single axis as each other.

28. The device as claimed in claim 25, wherein one of said plurality of sheet steering means is rotatable about a shaft coaxial with a shaft about which the other sheet steering means is rotatable.

29. The device as claimed in claim 25, further comprising shock absorbing members positioned on surfaces of said plurality of sheet steering means, which face each other and are positioned on both sides of the single axis, such that said shock absorbing members do not lie in a range over which the sheet is conveyed.

30. The device as claimed in claim 29, wherein said shock absorbing members each are positioned at one end of one of said surfaces facing each other.

31. The device as claimed in claim 25, wherein said plurality of sheet steering means are positioned in a branching portion where a sheet conveying path branches off, and a guide plate positioned at a side of the plane of sheet conveyance, said guide plate is formed with a space for receiving a sheet steering means of said plurality of sheet steering means.

32. The device as claimed in claim 25, wherein said plurality of sheet steering means comprise path selectors each having a wedge-shaped section.

33. A sheet conveying device comprising:

a first path selector and a second path selector provided at a branching portion of a sheet conveying path and provided on opposite sides of a plane of sheet conveyance of the sheet conveying path, said first path selector and said second path selector being rotatable about a single axis, said first path selector and said second path selector being configured to steer a sheet conveyed along the sheet conveying path in a particular direction; and drive actuators configured to move said first path selector and said second path selector independently of each other.

* * * * *